US006168248B1

(12) United States Patent
Timmons et al.

(10) Patent No.: US 6,168,248 B1
(45) Date of Patent: Jan. 2, 2001

(54) CONTAINMENT SYSTEM FOR PACKAGED AIR CONDITIONING UNIT

(75) Inventors: William P. Timmons; Joe W. Dark; John W. Schedel, all of Tyler, TX (US); Thomas P. Bruce, Columbus, MS (US); Bradley L. Kersh, Flint, TX (US); Ronald J. Duppert, East Syracuse; Eugene D. Daddis, Jr., Nedrow, both of NY (US)

(73) Assignee: Carrier Corporation, Syracuse, NY (US)

( * ) Notice: Under 35 U.S.C. 154(b), the term of this patent shall be extended for 354 days.

(21) Appl. No.: 08/631,359

(22) Filed: Apr. 12, 1996

(51) Int. Cl.[7] ..... A47B 47/03
(52) U.S. Cl. ..... 312/264; 312/100
(58) Field of Search ..... 312/264, 100

(56) References Cited

U.S. PATENT DOCUMENTS

| | | | | |
|---|---|---|---|---|
| 1,817,307 | * | 8/1931 | Haase et al. | 312/263 X |
| 3,357,763 | * | 12/1967 | Toper | 312/236 |
| 3,544,185 | * | 12/1970 | Lundberg | 312/264 X |
| 4,086,783 | * | 5/1978 | Wagner et al. | 312/236 X |
| 4,116,510 | * | 9/1978 | Franco | 312/263 X |
| 4,471,633 | * | 9/1984 | Tinsler | 62/295 |
| 4,618,193 | * | 10/1986 | Cuthbert et al. | 312/264 |
| 4,782,972 | * | 11/1988 | Wenkman et al. | 312/263 X |
| 4,800,734 | * | 1/1989 | Sauber et al. | 312/264 X |
| 4,893,478 | * | 1/1990 | Kruck et al. | 312/236 X |
| 5,372,415 | * | 12/1994 | Tisbo et al. | 312/263 X |
| 5,437,164 | * | 8/1995 | Consiglio | 62/259.1 |
| 5,491,611 | * | 2/1996 | Stewart et al. | 312/263 X |

FOREIGN PATENT DOCUMENTS

| | | | | |
|---|---|---|---|---|
| 1337461 | * | 8/1963 | (FR) | 312/264 |

* cited by examiner

*Primary Examiner*—Peter M. Cuomo
*Assistant Examiner*—David E Allred

(57) ABSTRACT

A containment system for a packaged air conditioning unit is disclosed comprising a base pan, a first unit wrapper, a second unit wrapper, a compressor compartment partition, a condenser compartment partition, and a top cover having an indoor section and an outdoor section. The unit wrappers and the compartment partitions are guided into position during installation by engaging a notch formed on the wrapper or partition with a positioning cleat formed on the base pan. Because the unit wrappers and the partitions firmly abut the base ban throughout their length, these components help to laterally stiffen the base pan.

6 Claims, 6 Drawing Sheets

CONTAINMENT SYSTEM FOR PACKAGED AIR CONDITIONING UNIT

BACKGROUND OF THE INVENTION

1. Field of the Invention

The present invention relates to air conditioning units in general, and specifically to an improved containment system for a packaged air conditioning unit.

2. Background of the Prior Art

Large ground-mounted or roof-mounted air conditioning units for light industrial or residential use, commonly known as "packaged" air conditioning units includes a containment system for containing the internal components thereof. The containment system of a packaged air conditioning unit is an important feature given that the unit is constantly subjected to environmental thermal stress and precipitation, and internal thermal stress resulting from the repeated cooling and heating of the unit, as well as moisture build-up within the unit. Furthermore, given the numerous sensitive internal components of the air conditioning unit, the containment system must repeatedly be partially disassembled and assembled to allow for servicing, maintenance, or replacement of these sensitive internal components.

A containment system of a conventional outdoor air conditioner includes an outer casing comprising of four sidewalls supported by four corner posts. Unfortunately, this configuration has been observed to lack structural integrity, is difficult to assemble, and does not provide easy access to the component parts of the contained unit.

Therefore, there exists a need for a sturdier, easier-to-assemble containment system for an air conditioning unit which provides for easy access to components of the unit for servicing and maintenance purposes.

SUMMARY OF THE INVENTION

According to its major aspects and broadly stated, the present invention is a containment system for a packaged air conditioning unit.

The containment system of the invention includes a horizontally-oriented base pan upon which components of the air conditioning unit are mounted, a first vertically-oriented unit wrapper supported by the base pan, a second vertically-oriented unit wrapper supported by the base pan, a condenser compartment partition, a compressor compartment partition, an indoor section top cover, and an outdoor section top cover. The unit wrappers, the condenser partition, the compressor partition, and the cover sections are formed preferably of sheet metal.

The base pan of the containment system includes a plurality of positioning cleats spaced apart from one another formed about its periphery. For each positioning cleat formed about the periphery of the base pan, there is a corresponding notch formed on one of the unit wrappers. Each unit wrapper has an L-shaped cross-section and extends the length of one side plus one end of the base pan. The unit wrappers are joined at seams formed at opposite corners of the base pan. Because the unit wrappers directly abut the base pan, the wrappers provide lateral stiffening to the base pan.

A compressor compartment partition partially defines a compressor compartment for the containment system. Meanwhile, a condenser compartment partition defines a condenser compartment along with the second unit wrapper. Like the unit wrappers, the compressor and condenser compartment partitions include spaced apart notches formed along their bottom edge which engage positioning cleats similar to the aforementioned peripheral positioning cleats. The compartment partitions also provide lateral stiffening to the base pan.

A top cover comprising an indoor section and an outdoor section is then secured to the unit wrappers and the partition sections. Because the cover comprises two parts, access to internal components is simplified insofar as such access requires removal of one relatively small containment component.

In addition to the advantages already mentioned, the containment system described above simplifies the assembly of the air conditioning unit, reduces the number of parts required to complete the cabinet assembly, improves the shipping and handling characteristics of the unit, and reduces product cost by eliminating piece parts.

BRIEF DESCRIPTION OF THE DRAWINGS

In the drawings, wherein like numerals are used to indicate the same elements throughout the views.

DETAILED DESCRIPTION OF THE PREFERRED EMBODIMENTS

Figure 1:
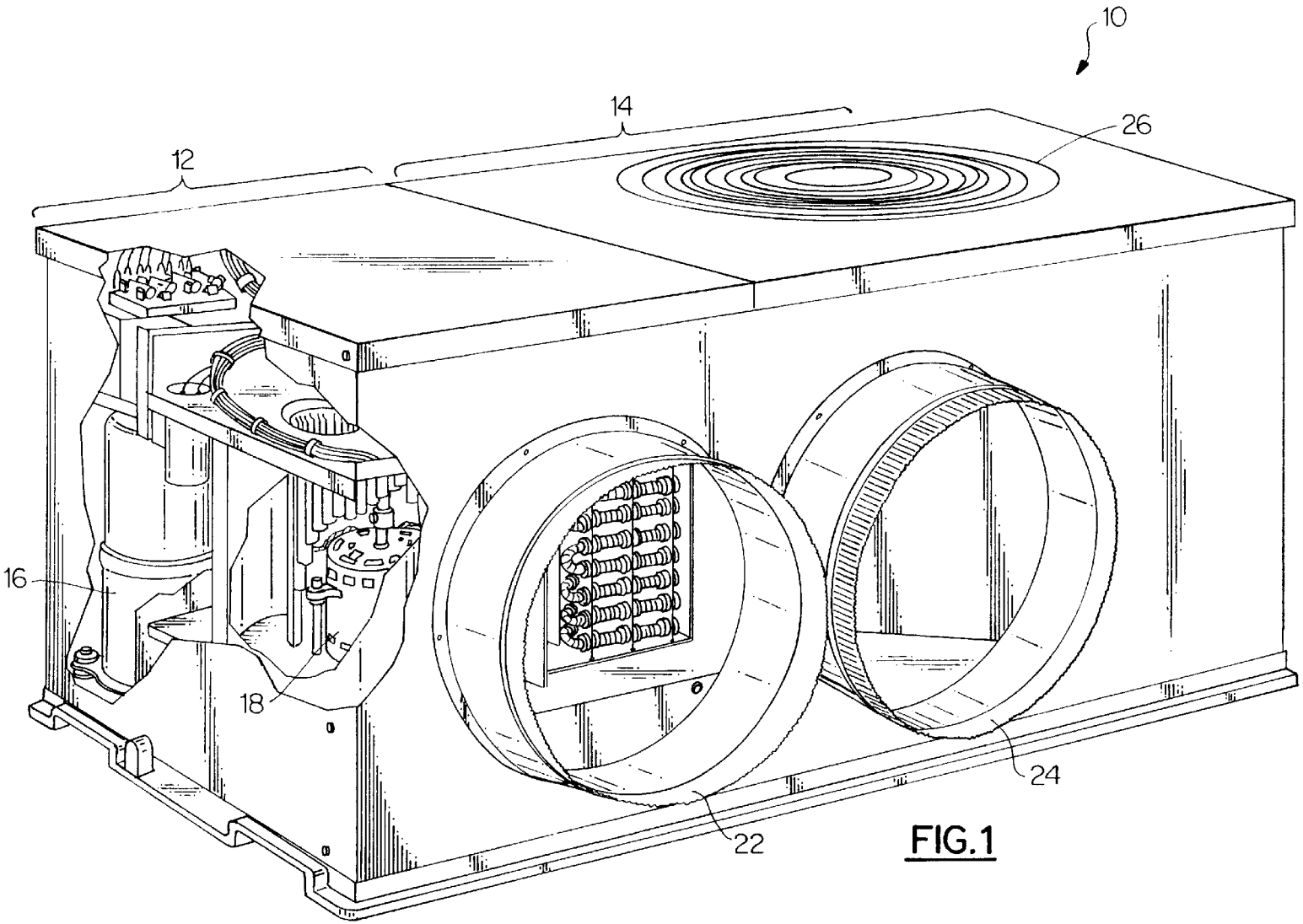
FIG. 1 is a perspective view of an air conditioning unit having a containment system according to the invention integrated therein.

A description of an air conditioning unit of the type which the present invention is integrated is made with reference to FIG. 1. Air conditioning unit 10 includes an indoor evaporator section 12 and an outdoor section 14. On installation, indoor section 12 connects to air ducts that supply conditioned air to the interior space of a building, while outdoor section 14 extends to the outside of a building.

Indoor section 12 of unit 10 includes a compressor 16 for increasing the pressure of refrigerant flowing in an outdoor coil or condenser (not shown), and a blower 18 for blowing air across an indoor coil, otherwise known as evaporator (not shown), through which cool liquid refrigerant flows.

Unit 10 may also have heating coils 20 or other heating elements which when activated work to supply heat to a building. When unit 10 is in a heating mode of operation, air that is blown by blower 18 is warmed by heating elements 20. When unit 10 is in a cooling mode of operation, air blown by blower 18 is cooled by the evaporator. Whether unit 10 is in a cooling mode or a heating mode, air that is blown by blower enters a building through supply air duct 22. Air that has circulated in building returns to unit 10 through return air duct 24.

In addition to having an outdoor coil or condenser, outside section of unit 10 includes an outdoor fan. The outdoor fan draws outside air into unit 10 through grating 25 and blows such air across a unit condenser which is filled with hot refrigerant. Outside air is directed out of unit 10 through vent 26. In this way, the condenser and fan operate to remove heat from a building.

During the course of operation of unit 10, the aforementioned components will be subjected to considerable structural stress. Rain and snow can enter into unit 10 directly through vent 26 or grating 25 to cause corrosion of or otherwise interfere with the operation of, a system fan, a condenser, or another component of unit 10. In addition, condensate will form on the indoor coil when unit 10 is in cooling mode of operation. This condensate will drip off of the inner coil and may cause corrosion of or otherwise interfere with operation of indoor components of unit 10.

As a result of the stress they encounter, components of packaged, ground-mounted air conditioning units normally require regular maintenance and servicing, and often require replacement. Accordingly, one object of the present invention is to provide a containment system which allows easy access to components of the unit.

Components of the containment system of unit 10, including the unit's exterior cabinet and its internal partitions are also subjected to significant structural stress. Accordingly, another object of the present invention is to provide a containment system which is designed to withstand significant structural stress.

Figure 2:
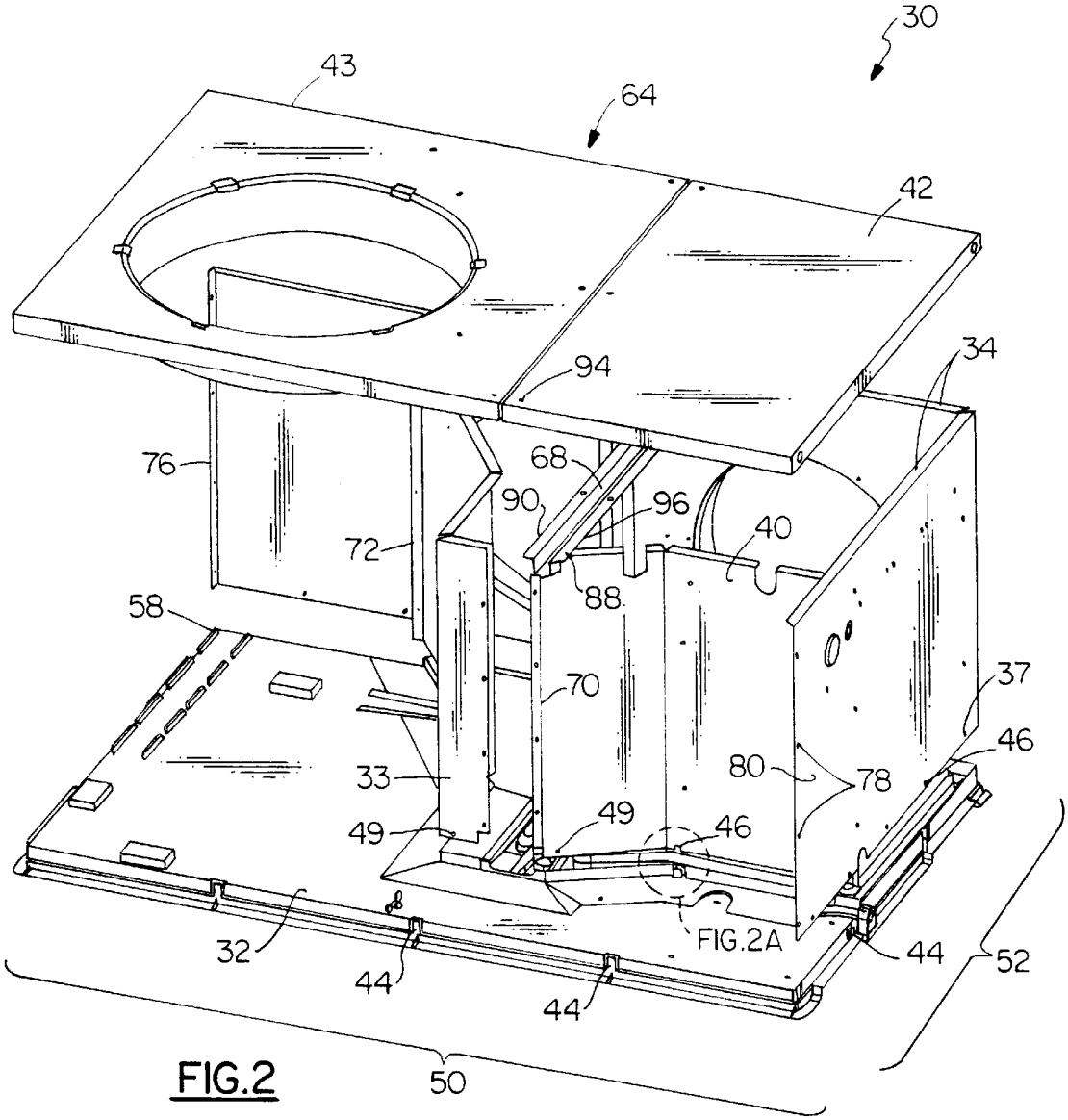
FIG. 2 is a perspective view illustrating the base pan, the first unit wrapper, a compressor compartment partition, and a condenser compartment partition.
Figure 2A:
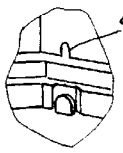
Figure 3:
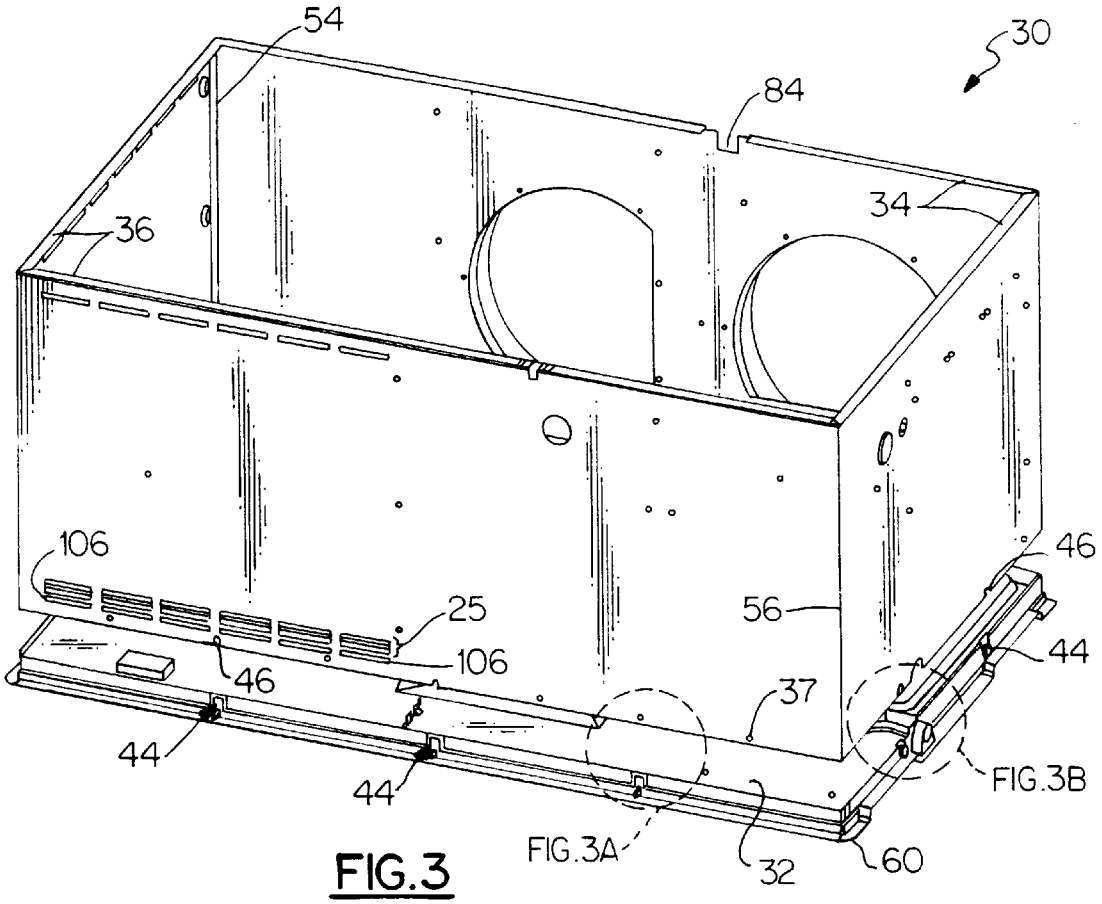
FIG. 3 is a perspective installation showing the base pan, and the unit wrappers of the invention.
Figure 3A:
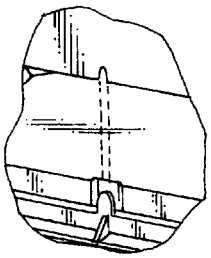
Figure 3B:
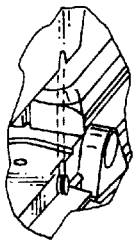

Now referring to FIGS. 2 and 3, containment system for a ground-mounted packaged air conditioning unit will be described in detail.

Containment system 30 includes a horizontally-oriented base pan 32 a first vertically-oriented unit wrapper 36 supported by base pan 32, a second vertically-oriented unit wrapper 34 supported by base pan 32, a condenser compartment partition 38, a compressor compartment partition 40, a top cover indoor section 42, and a top cover outdoor section 43. Unit wrappers 34 and 36, condenser partition 38 and the compressor partition 40 are formed preferably of sheet metal. First and second unit wrappers 34, 36 form a unit chassis.

Base pan 32 of the containment system includes a plurality of positioning cleats 44 spaced apart from one another formed about the periphery of base pan 32. For each positioning cleat formed about the periphery of the base pan 32, there is a corresponding notch 46 formed on one of the unit wrappers 34 and 36. Each unit wrapper has an L-shaped cross-section and extends the length of one side 50 plus one end 52 of the base pan. The unit wrappers are joined at seams formed at opposite corners, such as 58 and 60 of the base pan.

Compressor compartment partition 40 partially defines a compressor compartment for the containment system. Meanwhile, condenser compartment partition 38 defines a condenser compartment along with second unit wrapper 36. Like the unit wrappers, the compressor and condenser compartment partitions 40,38 include spaced apart notches 46 formed along their bottom edge which engage complementary positioning cleats formed on base pan 32.

A first group of positioning cleats formed about the base pan's periphery receives the unit chassis. A second group of positioning cleats formed at the base pans' interior receives compressor compartment partition 40, where a third group of positioning cleats also formed at the base pan's interior receives condenser compartment partition 38.

A top cover 64 comprising an indoor section 42 and an outdoor section 43 is then secured to the unit wrappers 34 and 36, and to bracket 68 which extends from first wrapper 34 to second wrapper 36 perpendicularly between the wrappers. The two-part cover configuration allows easy access to components located in either the indoor section 12 or the outdoor section 14 of the unit. The two-part cover design allows components located in one compartment to be accessed with removal of only one small component of the containment system.

Assembly of the containment system is as follows. First, base pan 32 is provided, and situated in a stable position or else situated on a conveyor belt for transport along an assembly line. Then, internal components of air conditioning unit 10 including compressor 16 the condenser blower 18, the outdoor fan and heating elements 20 can be mounted to or positioned on base pan 32 or else are mounted to internal mounting brackets which are secured to base pan 32.

Once internal components of the packaged air conditioning unit are mounted directly or indirectly to or positioned on the base pan 32, the remainder of the containment system components are installed. First unit wrapper 34 is abutted against base pan 32 so that notches 46 of wrapper 34 interlock with positioning cleats 44 formed on base pan 32. In this way, unit wrapper 34 is easily moved into a proper position on base pan. Once unit wrapper 34 is positioned in a proper position, screws are driven through holes 37 of wrapper 34 and bored through base pan 32 to firmly secure wrapper 34 to base pan 32. The notch and cleat arrangement greatly simplifies and speeds up the task of installing containment system components.

After first unit wrapper 34 is installed, the containment system's compartment partitions are installed. Compressor compartment partition 40 is first moved into an appropriate position on base pan 32 by interlocking notches 46 of partition 40 with positioning cleats 44 of base pan 32. To firmly secure compressor partition 40 in a secure position, screws or bolts are driven through axially aligned holes of unit wrapper 34 and of an elongated tab (not shown) extending perpendicularly from an edge of partition 40. Condenser compartment partition 38 is then moved into position by interlocking notches 46 of partition 38 with at least one cleat formed on base pan 32. Condenser compartment partition 38 is secured to compressor compartment partition by driving bolts or screws through aligned holes formed on an elongated tab 70 of compressor partition 40 and on condenser compartment partition 38. Screws or bolts are also driven through aligned holes of rear elongated tab 72 and of unit wrapper 34. In addition, screws are driven through holes 49 of compressor and condenser partition 38, 40 and bored into base pan 32.

Second unit wrapper 36 is moved into an appropriate position again by engaging notches of wrapper 36 with positioning cleats 44 of base pan 32. Second unit wrapper 36 is secured by driving bolts or screws through aligned holes of pan 32 and wrapper 36 as best seen in FIG. 3. In addition, second wrapper 36 is secured to first wrapper 34. At each seam 54 and 56 (located at diagonally above opposing corners of pan) bolts or screws are driven through holes formed on an elongated tab eg. 76 formed on one of the wrappers and through corresponding holes 78 formed on the other unit wrapper. For example, holes 78 formed at the edge 80 of first wrapper 34 will align with holes formed on an elongated tab (not shown) of second wrapper 36. Skilled artisans will recognize that the ordering of the above installation steps can be altered.

Because the unit wrappers 34,36 and the compartment partitions 38 and 40 all firmly abut base pan 32 all of these containment system components contribute to the lateral stiffening of base pan 32. Such lateral stiffening is especially important considering that the base pan will be subjected to significant environmental stress over time, and may become brittle if, for example, it is made of a corrosive material. The lateral stiffening provided by containment system components 34, 36, 38 and 40 will reinforce base pan 32 so that it is strong enough to support unit components eg. 16, 18, 20 despite being corroded or otherwise weakened. For eliminating or mitigating corrosion of base pan 32, base pan 32 may be made of a non-corrosive or corrosion-resistant material. A preferred material for base pan is AZDEL, a composite available from General Electric Corporation as described in commonly assigned application Ser. No. 08/762,570 entitled "Improved Base Pan for Packaged Air Conditioning Unit," incorporated entirely by reference herein.

Even if the base pan is made of a non-corrosive or corrosion resistant material, then the lateral stiffening provided by vertical containment components 34, 36, 38 and 40 is beneficial because such stiffening allows a relatively weak and inexpensive material to be used as a base pan.

After the vertically oriented containment components 34, 36, 38, and 40 are installed, the containment system's cover is installed. Cover 64 includes indoor section 42 and outdoor section 43. Before installing indoor cover 42 and outdoor cover 43, bracket 68 is mounted between first wrapper 34 and second wrapper 36. Specifically, bracket 68 is positioned perpendicularly between first and second wrappers 34 and 36 on guide cavities 84, 86 as shown in FIGS. 2 and 3 and secured to the wrappers by way of screws or bolts driven through aligned holes of bracket 68 and of the unit chassis. Bracket 68 includes a first elongated tab 88 for receiving indoor cover section 42 and a second elongated tab 90 for receiving outdoor cover section 43. Cover sections 42,43 are secured to the remainder of the containment system by way of screws or bolts. Specifically, indoor section 42 is secured by screws or bolts driven through aligned holes eg. 94,96 of indoor section 42 and of bracket 68 and through aligned holes of cover section 42 and unit wrappers 34 and 36. Outdoor cover 43 is secured by driving screws or bolts through aligned holes of outdoor section and of bracket 68, and through aligned holes of outdoor section 43 and first and second wrappers 34 and 36.

Most of the sensitive components of the air conditioning unit 10, including compressor 16, the indoor coil, blower 18, and heating elements 20 will be located inside the indoor compartment 12. Because cover 64 is divided into two parts: An indoor section and an outdoor section, servicing, maintaining and replacing of internal components of unit is simplified by the fact that only one relatively small component of the containment system needs to be removed to allow access to these internal components.

Figure 4:
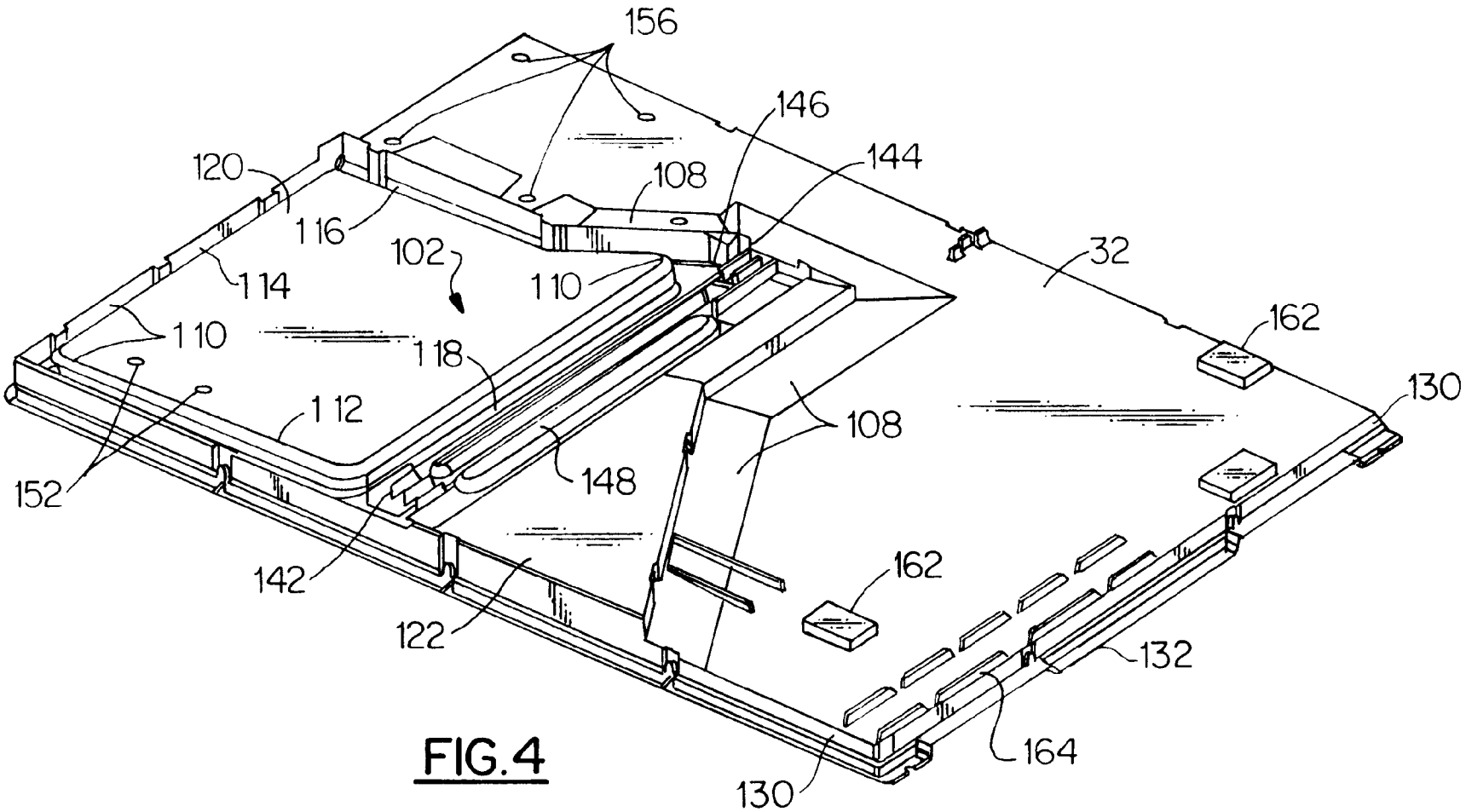
FIG. 4 is a first perspective view of a base pan according to the invention.
Figure 5:
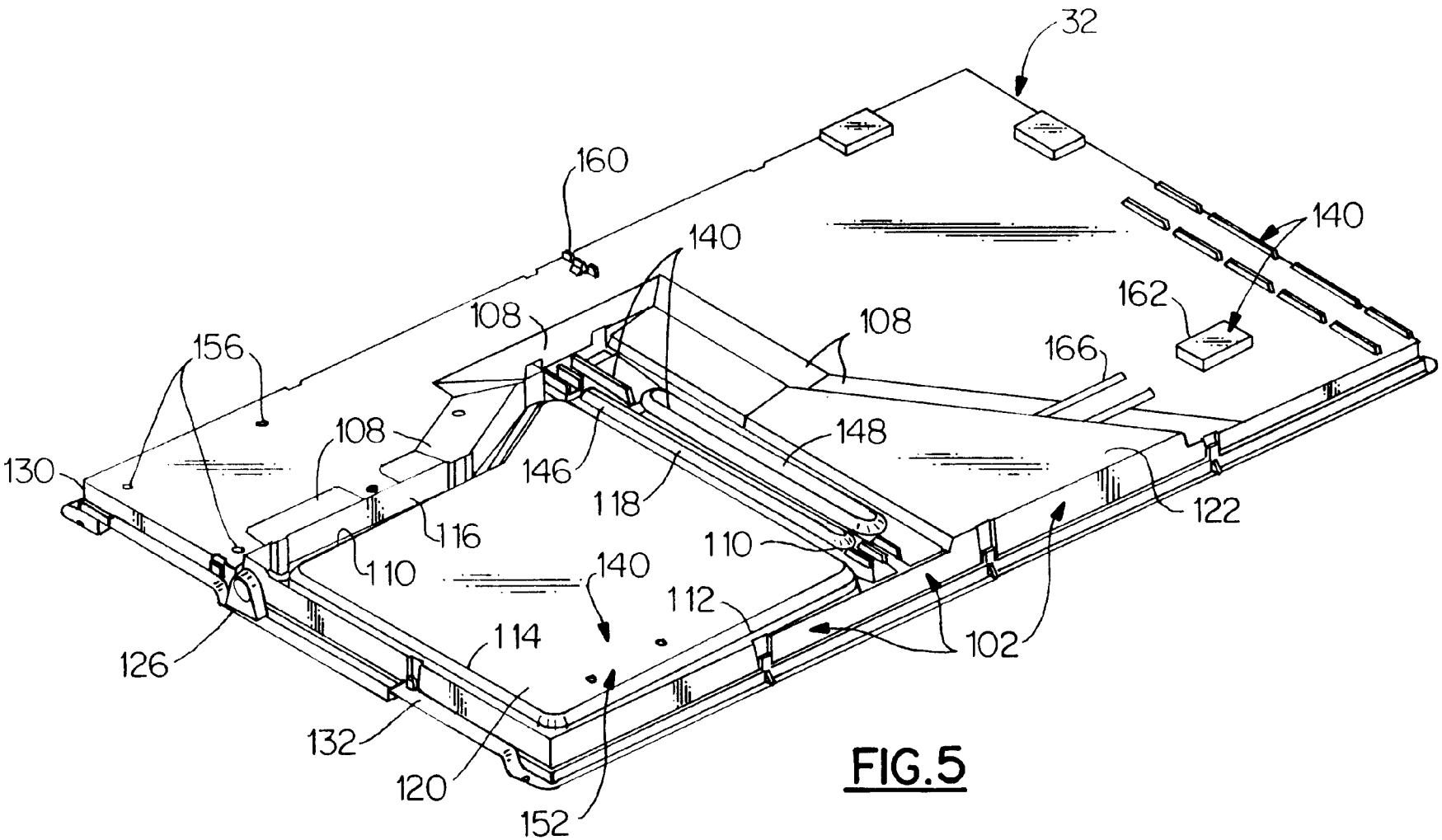
FIG. 5 is a second perspective view of a base pan according to the invention.
Figure 6:
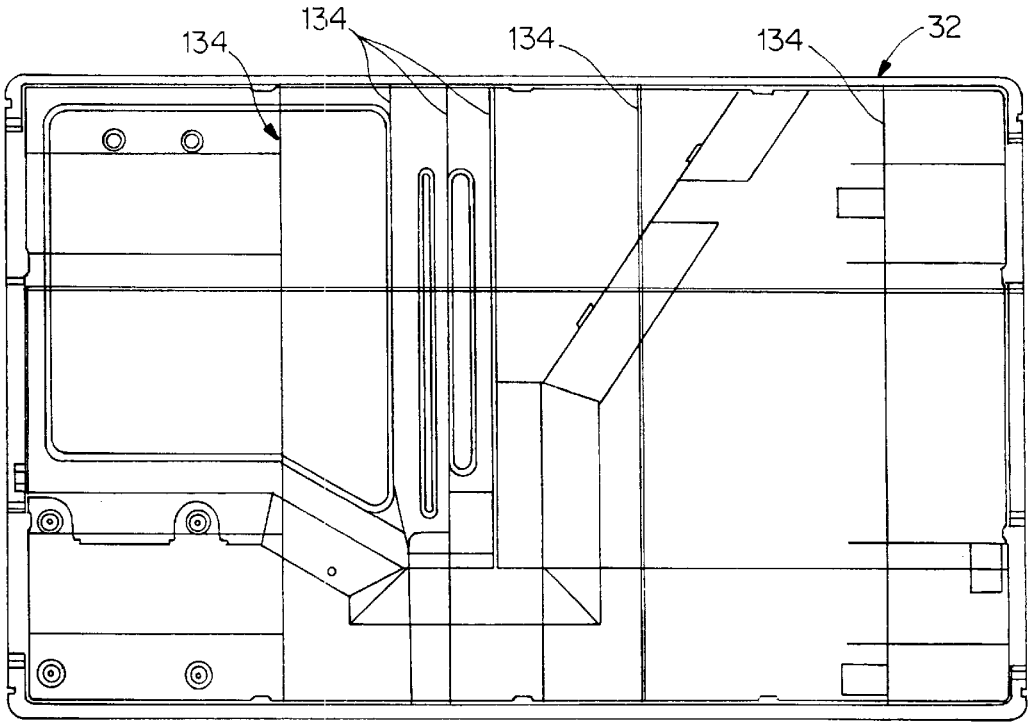
FIG. 6 is a top view of a base pan bottom according to the invention.

With reference now to FIGS. 4–6 features of a preferred base pan according to the invention will be described in detail.

An important feature of the present invention is selection of material for base pan 32. Preferably base pan 32 is made of a-non-corrosive polymer material. This in contrast to base pans of the prior art which are typically made of inexpensive metal which offers the advantages of being inexpensive, structurally strong, and non-flammable despite being corrosive. A base pan according to the present invention can be made of virtually any polypropylene material. A most preferred material for the base pan is AZDEL of the type manufactured by General Electric Corporation of Stamford Conn.

While non-corrosive, inexpensive, and structurally strong, the above preferred materials are also flammable. To the end base pan 32 is fire-resistant despite comprising a flammable material, regions of the base pan that will be exposed to significant heat during the course of operation are coated with a non-flammable material. A typical air conditioner base pan includes an airflow section, shown generally by 102 above which are supported compartment partitions 38 and 40, a unit's indoor coil and a unit's blower 18 as shown in FIGS. 1 and 2. Return air from the building which is cooled flows into airflow compartment 104, the area above the airflow section 102 of base pan 32, and is forced back into the building after being cooled. In the present invention, the airflow section of the base pan is coated with a non-corrosive, non-flammable material in order to make this area of the base pan flame resistant. A base pan according to the invention can be coated for example, by any metal applied by any conventional coating method. In one preferred embodiment, the airflow section of the base pan is coated with zinc. The zinc material applied to the base pan may be ARC SPRAY 02ZZINCWIRE of the type manufactured by Hobart-Tafa Technologies of Concord, N.H. Applied by spraying onto the airflow section of the base pan, this metal coating features the advantage of adhering especially strongly to a polypropylene substrate. The design described above provides an inexpensive, non-corrosive, and flame resistant base pan.

The base pan is preferably a unitary article of manufacture formed by a process of compression molding.

In addition to its material selection, structural features of improved base pan 32 contribute to improved structural integrity of the base pan and of other components of air conditioning unit 10. The top surface of base pan 32 is generally flat but is characterized by a gentle crown so that moisture dropping to a point in proximity with the center of the pan tends to drain toward the pan's periphery. As best seen in FIG. 3, unit wrappers 34 and 36 include drain slits 106 formed at a level approximately flush with the surface of base pan 32, for allowing precipitation and condensate to drain from base pan 32.

Airflow section 102 of base pan 32 is formed on a raised platform which is raised from the remainder of the base pan's top surface. The raised airflow section 102 is formed at one corner of the pan so that the airflow region partially borders on a corner of base pan 32, and partially borders toward the base pan interior. Ramp members 108 are formed between the border of the raised platform and base pan 32.

The combination of raised platform 102 and ramp members 108 serve an important function. Specifically, the combination of raised airflow section 102 and ramp members 108 serves to direct precipitation and condensate away from the airflow compartment 104, wherein the unit components subjected to the most significant degree of stress are housed. The ramp members, in general, are sloped more severely than other areas of the top surface. While the values are not critical the slope over ramp members typically about 4.5° while the remainder of the pan top surface is sloped to a slope of about 1.5° toward channel 110 or toward the periphery of the top surface.

Condensate or other moisture droplets that drop onto the airflow section 102 of base pan 32 are directed to channel 110 which is formed within the airflow section. In the embodiment shown in FIGS. 3 and 4, channel 110 includes three sides 112, 114, and 116 formed along the periphery of airflow section 102 and a fourth side 118 which divides airflow section 102 into a drain pan section 120 and a return air section 122. As shown in FIG. 2, the indoor coil of unit 10 is positioned above fourth channel side 118 so that most of the condensate formed on the indoor coil drops into channel 110 at the fourth side thereof.

Channel 110 is sloped throughout its length so that condensate and other liquid collecting therein drains through drain hole 126 in fluid communication with the exterior of air conditioning unit. Drain hole 126 may be interfaced, for example, to a drainage system of a building or with a garden irrigation system. While a minimal amount of liquid is expected to drop thereon, return air surface 122 of air flow section 102 slopes toward fourth side 118 of channel 110. Drain pan surface 120 of airflow section 102, meanwhile, is sloped or crowned so that liquid dropping thereon drains toward channel 110.

As seen in FIGS. 4 and 5, the top surface of base pan 32 is elevated from the ground by neck 130 which extends the entire periphery of base pan 32. Neck 130 is supported by rim 132 which extend perpendicularly from neck 130 throughout its length. The periphery of rim 132 is offset typically about 0.75 inches from the periphery of the top surface of base ban 32. This design allows packaging of unit 10 such that direct contact with the unit chassis or with cover 64 minimized during shipment of unit 10. Shown in FIG. 6., stiffening ribs 134 formed throughout the underside of base pan 32 laterally stiffen base pan to further increase the base pan's structural integrity.

In addition the features thusfar described, base pan 32 further comprises a number of positioning formations 140 which are formed as integral elements with the remainder of base pan 32. In a conventional design, mounting brackets are mounted directly to the base pan, and air conditioning equipment components, e.g. 16, 18, are then secured to the mounting brackets. The present design having integrated positioning formations 140 reduces the number of parts required for assembly of an air conditioning unit and reduces assembly time. Furthermore, positioning formations 140 improve the structural integrity of the base pan by reducing the number of bolt holes required to be formed on the base pan, and by reducing the overall load supported by base pan 32. In the present invention, positioning formations 140 merely non-fixedly position air conditioner components in a proper orientation and do not fully support the load of the components. In general, air conditioner components, e.g. 16, 18 are secured to unit 10 in a fixed position by bolts or screws driven through aligned holes of the components and of the unit chassis 34, 36.

Positioning formations 140 formed on base pan 32 can take a variety of different forms which will depend on the specific features of the mounting apparatus of the particular component being positioned. In the embodiment of FIGS. 1–6, the indoor coil of unit 10 is positioned by a positioning formation which comprises first set of ridges 142, a second set of ridges 144 and a pair of elongated bar mounts 146, 148. The positioning formations which position blower 18 and compressor 16 comprise a set of two holes 152 and a set of four holes 156, respectively. The condenser of unit 10, meanwhile, is positioned by a positioning formation comprising a set of tabs 160, three positioning pedestals 162, a first set of ridges 164, and a second set of ridges 166.

It will be recognized that while the containment system and base pan of the invention have been described with reference specifically to a packed air conditioning unit, that the teachings herein can be applied to any containment structure for containing internal equipment component, which will be subjected to significant structural stress over time.

While the present invention has been explained with reference to a number of specific embodiments, it will be understood that the spirit and scope of the present invention should be determined with reference to the appended claims.

What is claimed is:

1. A containment system for a packaged air conditioning unit, said containment system comprising:

a base pan having a first group of positioning cleats formed about its periphery, said base pan having two sides and two edges forming four corners;

a first unit wrapper having an L-shaped cross-section received on said base pan and extending the length of one side plus one edge of said base pan, said first unit wrapper having spaced apart notches formed along a bottom edge thereof, said spaced apart notches receiving a second portion of said first group of positioning cleats;

a second unit wrapper having an L-shaped cross-section received on said base pan and extending the length of one side plus one edge of said base pan, said second unit wrapper having spaced apart notches formed along a bottom edge thereof, said spaced apart notches receiving a first portion of said first group of positioning cleats, said second unit wrapper joining said first unit wrapper at a first seam formed above a first corner of said base pan, and at a second seam formed above a second corner of said base pan, said first and second unit wrappers forming a unit chassis and firmly abutting a horizontal surface of said base pan and being attached by fasteners to a vertical portion of said base pan so as to stiffen said pan from flexing in a vertical direction and stiffen said wrappers from flexing in a horizontal direction; and a top cover mounted to said unit chassis.

2. The containment system of claim 1, wherein said base pan further includes a second group of positioning cleats and a third group of positioning cleats, said containment system further comprising:

a compressor compartment partition partially defining a compressor compartment, said compressor compartment partition having spaced apart compressor partition notches formed along a bottom edge thereof, said compressor compartment notches receiving said second group of positioning cleats; and a condenser compartment partition partially defining a condenser compartment, said condenser compartment partition having spaced apart condenser partition notches formed along a bottom edge thereof, said condenser compartment notches receiving said third group of positioning cleats, said compressor and condenser compartment partitions firmly abutting a horizontal surface of said base pan and being attached bv fasteners to a vertical portion of said base pan so as to stiffen said base pan from flexing in a vertical direction and stiffen said condenser compartment partition from flexing in a horizontal direction.

3. The containment system of claim 1, wherein said top cover includes an indoor section and an outdoor section, whereby access to one internal component of said unit requires removal of only one of either of said indoor section or said outdoor section of said top cover.

4. The containment system of claim 1, further including a bracket extending perpendicularly from said first unit wrapper to said second unit wrapper, wherein said top cover includes an indoor section received by said bracket and said first and second unit wrappers, and an outdoor section received by said bracket and said first and second unit wrappers.

5. The containment system of claim 1, wherein said base pan comprises a non-corrosive composite material.

6. The containment system of claim 1, wherein said base pan comprises a polypropylene material.

* * * * *